US008221147B2

(12) United States Patent
Ozeki

(10) Patent No.: US 8,221,147 B2
(45) Date of Patent: Jul. 17, 2012

(54) ELECTRICAL CONNECTOR

(75) Inventor: Kosuke Ozeki, Tokyo (JP)

(73) Assignee: I-PEX Co., Ltd. (JP)

( * ) Notice: Subject to any disclaimer, the term of this patent is extended or adjusted under 35 U.S.C. 154(b) by 270 days.

(21) Appl. No.: 12/767,389

(22) Filed: Apr. 26, 2010

(65) Prior Publication Data

US 2011/0104936 A1 May 5, 2011

(30) Foreign Application Priority Data

May 13, 2009 (JP) ..... 2009-116227

(51) Int. Cl.
*H01R 13/62* (2006.01)

(52) U.S. Cl. ..... 439/260

(58) Field of Classification Search ..... 439/260, 439/345–358, 495–496
See application file for complete search history.

(56) References Cited

U.S. PATENT DOCUMENTS 3,801,756 A * 4/1974 Krom et al. ..... 200/43.07
6,866,535 B2 * 3/2005 Uchida ..... 439/357
7,347,720 B2 * 3/2008 Takashita ..... 439/495
2006/0252310 A1 * 11/2006 Yamada et al. ..... 439/579
2007/0032115 A1 * 2/2007 Takashita ..... 439/260
2011/0165788 A1 * 7/2011 Tagawa et al. ..... 439/345

FOREIGN PATENT DOCUMENTS

JP 2008-052993 A 3/2008
JP 2008-192574 A 8/2008

* cited by examiner

*Primary Examiner* — Jean F Duverne
(74) *Attorney, Agent, or Firm* — Studebaker & Brackett PC; Donald R. Studebaker

(57) ABSTRACT

An electrical connector including a housing provided thereon with an opening through which a flexible printed circuit board (an FPC) is inserted into the housing, a plurality of conductive contacts arranged on the housing, a conductive shell mounted on the housing for covering partially the same and provided with a holding member, and a movable lever, wherein the holding member comprises an arm portion extending from the conductive shell to the inside thereof, an engaging projection provided at an end of the arm portion for engaging with an engaging edged portion provided on the FPC inserted in the housing so as to hold the FPC, a pressure receiving portion extending from the engaging projection for receiving pressure from the movable lever and an indicating portion extending from the pressure receiving portion to take up selectively first and second positions for indicating a state of the holding member, and the indication portion taking up at least one of the first and second positions is able to be visually checked from the outside of the conductive shell.

7 Claims, 11 Drawing Sheets

ELECTRICAL CONNECTOR

BACKGROUND OF THE INVENTION

1. Field of the Invention

The present invention relates generally to an electrical connector, and more particularly to an improvement in an electrical connector which has a housing, holding means for engaging with a flat circuit device, such as a flexible printed circuit board (hereinafter, referred to as an FPC) or a flexible flat cable assembly (hereinafter, referred to as an FFC) inserted in the housing, so as to hold the same to be prevented from getting out of the housing unwillingly and a plurality of conductive contacts provided for coming into press-contact with connecting terminals provided on the flat circuit device so as to put the flat circuit device in electrical connection with another electrical device, such as a main solid circuit board.

2. Description of the Prior Art

A flat circuit device, such as a relatively small-sized FPC or FFC, used in electronic apparatus of various kinds is often mounted on a main solid circuit board, on which various electrical parts are directly mounted, with an electrical connector which is fixed to and connected electrically with the main solid circuit board. The electrical connector has a plurality of conductive contacts, an end portion of each of which is connected electrically with a conductive circuit pattern portion formed on the main solid circuit board and which are provided for coming into contact with connecting terminals provided on the flat circuit device, and is operative to connect electrically, through the conductive contacts, each of the connecting terminals provided on the flat circuit device with the conductive circuit pattern portion formed on the main solid circuit board.

A first type of previously proposed electrical connector used for mounting a flat circuit device, such as an FPC, on a main solid circuit board, is provided with a housing made of insulator, which is fixed on the main solid circuit board and has an opening through which at least a part of the flat circuit device is inserted into the housing. In the housing, a plurality of conductive contacts are provided to be arranged along the opening. These conductive contacts are operative to come into contact respectively with a plurality of connecting terminals provided on the flat circuit device when the flat circuit device is inserted into the housing through the opening. The previously proposed electrical connector of the first type is also provided with a conductive shell which covers partially the housing and is grounded to be operative to shield the conductive contacts in the housing from electromagnetic wave noises coming from the outside. The previously proposed electrical connector of the first type is further provided with an actuator which is provided to be rotatable in regard to the housing so as to engage with each of the conductive contacts arranged in the housing. When the actuator is rotated in a first direction in regard to the housing, an operating portion of each of the conductive contacts is moved by the actuator to put the conductive contact in press-contact with a corresponding one of the connecting terminals provided on the flat circuit device, and then, when the actuator is rotated in a second direction opposite to the first direction in regard to the housing, the conductive contacts put in press-contact with the connecting terminals provided on the flat circuit device are released from the press-contact with the connecting terminals. With the conductive contacts put in press-contact with the connecting terminals provided on the flat circuit device, the flat circuit device is put in electrical connection with the main solid circuit board.

A second type of previously proposed electrical connector used for mounting the flat circuit device on the main solid circuit board is provided with a housing fixed on the main solid circuit board, a plurality of conductive contacts and a conductive shell in such a manner as mentioned above but is not provided with an actuator rotatable in regard to the housing. In the previously proposed electrical connector of the second type, when the flat circuit device is inserted into the housing through an opening provided thereon, each of the conductive contacts provided in the housing to be arranged along the opening is automatically put in press-contact with a corresponding one of connecting terminals provided on the flat circuit device. That is, the flat circuit device is put in electrical connection with the main solid circuit board by means of only inserting correctly the flat circuit device into the housing through the opening provided thereon.

In the previously proposed electrical connector with or without the actuator rotatable in regard to the housing, when the flat circuit device is inserted into the housing through the opening provided thereon and the conductive contacts provided in the housing are put in press-contact with the connecting terminals provided on the flat circuit device so that the flat circuit device is put in electrical connection with the main solid circuit board, it is required to prevent the flat circuit device inserted in the housing from getting out of the housing unwillingly. It is a matter of course that it is necessary for the flat circuit device inserted in the housing to be held stably so as not to get out of the housing unwillingly in order to keep the conductive contacts provided in the housing properly in a condition of press-contact with the connecting terminals provided on the flat circuit device.

There has been also proposed previously an electrical connector belonging to the above mentioned first type having the housing, the conductive contact, the conductive shell and the actuator, which is provided with holding means for engaging with a flat circuit device, such as an FPC or FFC, inserted in the housing so as to hold the same to be prevented from getting out of the housing unwillingly, as shown in, for example, the Japanese patent application published before examination under publication number 2008-52993 (hereinafter, referred to as published patent document 1).

Besides, there has been further proposed previously an electrical connector belonging to the above mentioned second type having the housing, the conductive contact and the conductive shell, which is provided with holding means for engaging with a flat circuit device, such as an FPC or FFC, inserted in the housing so as to hold the same to be prevented from getting out of the housing unwillingly, as shown in, for example, the Japanese patent application published before examination under publication number 2008-192574 (hereinafter, referred to as published patent document 2).

In the electrical connector shown in the published patent document 1, the holding means (a locking portion 11c) is formed in a part of the conductive shell (a shield plate 11) to be able to seesaw with an engaging end portion (a nail portion 11d) curved to the inside of the conductive shell. The holding means shifts its position in response to a movement of the actuator (an actuator 9) provided to be rotatable in regard to the housing (a housing 3).

Then, when the actuator is rotated in a first direction in regard to the housing after the flat circuit device (an FPC 21) is inserted into a receiving space (an FPC receiving space 34) provided in the housing, each of the conductive contacts (first contacts 5, second contacts 6) provided in the housing is caused to shift its position by a cam (a cam portion 92 or 93) formed on the actuator so as to be put in press-contact with a corresponding one of connecting terminals provided on the flat circuit device inserted in the housing and the holding means is caused to shift its position by a com (a cam portion 94) formed on the actuator so as to cause the engaging end portion of the holding means to engage with an engaging portion (a recess 21a) formed on the flat circuit device. As a result, the flat circuit device inserted in the housing is prevented from getting out of the housing unwillingly.

After that, when the actuator is rotated in a second direction opposite to the first direction in regard to the housing under a condition wherein the engaging end portion of the holding means engages with the engaging portion formed on the flat circuit device, the cam (the cam portion 94) formed on the actuator allows the holding means to release the engaging end portion of the holding means from the engagement with the engaging portion formed on the flat circuit device. As a result, the flat circuit device is put in a condition to be able to get out of the housing.

Further, in the electrical connector shown in the published patent document 2, the conductive shell (a shell 4) is provided to be rotatable to the housing (a housing body 2) and the holding means (a leg portion 46) in the form of a leaf spring is formed in a part of the conductive shell. The holding means has an engaging projection (44) formed at an end of the holding means to be curved to the inside of the conductive shell.

When the flat circuit device (an FPC) is inserted into the housing through the opening (an opening 21) provided thereon under a condition wherein the conductive shell is positioned to keep lying down on the housing so as to be close in its entirety to the housing, each of the conductive contacts (upper contacts 31, lower contacts 32) provided in the housing is caused to be put in press-contact with a corresponding one of connecting terminals provided on the flat circuit device inserted in the housing and the engaging projection formed on the holding means is caused to engage with an engaging portion (an FPC engaging hole 2) provided on the flat circuit device. As a result, the flat circuit device inserted in the housing is prevented from getting out of the housing unwillingly.

After that, when the conductive shell is rotated to be positioned to keep rising from the housing under a condition wherein the engaging projection formed on the holding means is put in engagement with the engaging portion formed on the flat circuit device, the holding means formed in the conductive shell shifts its position in response to a movement of the conductive shell so as to release the engaging projection provided on the holding means from the engagement with the engaging portion formed on the flat circuit device. As a result, the flat circuit device is put in a condition to be able to get out of the housing.

In each of the electrical connectors thus proposed previously, which is provided with the holding means operative to prevent the flat circuit device inserted in the housing from getting out of the housing unwillingly, the holding means, which is put in operation to prevent the flat circuit device inserted in the housing from getting out of the housing unwillingly, assumes a posture which is entirely or almost the same as a posture assumed by the holding means which is not put in operation to prevent the flat circuit device inserted in the housing from getting out of the housing unwillingly or takes up a position which is entirely or almost the same as a position taken up by the holding means which is not put in operation to prevent the flat circuit device inserted in the housing from getting out of the housing unwillingly. Further, the flat circuit device, which is inserted in the housing and prevented by the holding means from getting out of the housing unwillingly, assumes a posture which is entirely or almost the same as a posture assumed by the flat circuit device which is inserted in the housing but not prevented by the holding means from getting out of the housing unwillingly.

This means that, with the previously proposed electrical connector put to practical use, it is very difficult to confirm quickly and accurately by means of visual check or feeling check from the outside of the electrical connector that the flat circuit device inserted in the housing has reached an appropriate position in the housing to be surely prevented by the holding means from getting out of the housing unwillingly. Accordingly, particular additional operations are required for confirming that the flat circuit device inserted in the housing has been put in an appropriate condition to be connected electrically with, for example, a main solid circuit board to which the electrical connector is fixed with electrical connection. This results in problems or disadvantages that the number of steps of work for producing the electrical connector increases and the production cost of the electrical connector rises.

OBJECTS AND SUMMARY OF THE INVENTION

Accordingly, it is an object of the present invention to provide an electrical connector used for mounting a flat circuit device, such as an FPC or FFC, on a main solid circuit board, which comprises a housing made of insulator and provided with an opening through which a flat circuit device is inserted into the housing, a plurality of conductive contacts provided to be arranged on the housing, and a conductive shell covering partially the housing, and which avoids the aforementioned disadvantages encountered with the prior art.

Another object of the present invention is to provide an electrical connector used for mounting a flat circuit device, such as an FPC or FFC, on a main solid circuit board, which comprises a housing made of insulator and provided with an opening through which a flat circuit device is inserted into the housing, a plurality of conductive contacts provided to be arranged on the housing, and a conductive shell covering partially the housing, and in which the flat circuit device inserted in the housing can be surely prevented from getting out of the housing unwillingly by a holding member formed in the conductive shell and the conductive contacts provided in the housing can be stably and appropriately kept in a condition of press-contact with a plurality of connecting terminals provided on the flat circuit device.

A further object of the present invention is to provide an electrical connector used for mounting a flat circuit device, such as an FPC or FFC, on a main solid circuit board, which comprises a housing made of insulator and provided with an opening through which a flat circuit device is inserted into the housing, a plurality of conductive contacts provided to be arranged on the housing, and a conductive shell covering partially the housing, and with which it is very easy to confirm quickly and accurately by means of visual check or feeling check from the outside of the electrical connector that the flat circuit device inserted in the housing has reached an appropriate position in the housing to be surely prevented from getting out of the housing unwillingly by a holding member formed in the conductive shell.

According to the present invention, as claimed in any one of claims, there is provided an electrical connector, which comprises a housing made of insulator and provided with an opening through which a flat circuit device, such as an FPC or FFC, is inserted into the housing, a plurality of conductive contacts provided to be arranged on the housing and positioned to correspond respectively to connecting terminals provided on the flat circuit device when the flat circuit device is inserted into the housing through the opening provided thereon, a conductive shell mounted on the housing for covering partially the same and provided with a holding member formed in a body therein for holding the flat circuit device inserted in the housing, and a movable lever provided to be rotatable in regard to the housing for taking up a first station and a second station selectively, wherein the holding member formed in the conductive shell comprises an arm portion extending from the conductive shell to the inside thereof, an engaging projection provided at an end of the arm portion for engaging with an engaging edged portion provided on the flat circuit device, a pressure receiving portion extending from the engaging projection for receiving pressure from the movable lever and an indicating portion extending from the pressure receiving portion for indicating a state of the holding member, the engaging projection is operative to engage with the engaging edged portion provided on the flat circuit device inserted in the housing so as to hold the flat circuit device and the indication portion is operative to take up a first position when the movable lever is postured to take up the first station, the pressure receiving portion is operative to be moved by the movable lever to release the engaging projection from engagement with the engaging edged portion provided on the flat circuit device inserted in the housing so as not to hold the flat circuit device and to cause the indication portion to take up a second position different from the first position when the movable lever is rotated from the first station to the second station, and the indication portion taking up at least one of the first and second positions is able to be visually checked from the outside of the conductive shell.

Especially, in one embodiment of electronic connector in accordance with the present invention, the movable lever has a pair of rotating axis portions supported to be rotatable by the housing and a pressing portion extending from each of the rotating axis portions to be rotatable with an imaginary axis of rotation passing through the rotating axis portions. The pressing portion is operative to cause the engaging projection of the holding member formed in the conductive shell to engage with the engaging edged portion provided on the flat circuit device inserted in the housing when the movable lever is postured to take up the first station and to move the pressure receiving portion of the holding member so as to release the engaging projection of the holding member from the engagement with the engaging edged portion provided on the flat circuit device inserted in the housing when the movable lever is rotated from the first station to the second station.

Further, in another embodiment of electronic connector in accordance with the present invention, the holding member is formed with resiliency in the conductive shell. The engaging projection of the holding member is operative to come into press-contact with the flat circuit device inserted in the housing so as to cause the holding member to be resiliently deformed just before engaging with the engaging edged portion provided on the flat circuit device and the pressure receiving portion of the holding member is operative to hit with resilient force against a portion, for example, the pressing portion of the movable lever when the engaging projection of the holding member engages with the engaging edged portion provided on the flat circuit device inserted in the housing.

In the electrical connector thus constituted in accordance with the present invention, the movable lever postured to take up the first station is positioned in its entirety to keep lying down on the housing and the movable lever postured to take up the second station is positioned in its entirety to keep rising from the housing.

When the flat circuit device is inserted into the housing thorough the opening provided thereon under a condition wherein the movable lever is postured to take up the first station, each of the conductive contacts provided to be arranged in the housing comes into press-contact with the corresponding one of the connecting terminals provided on the flat circuit device inserted in the housing, the engaging projection of the holding member formed in the conductive shell engages with the engaging edged portion provided on the flat circuit device inserted in the housing so as to hold the flat circuit device, and the indicating portion of the holding member takes up the first position. The indicating portion taking up the first position is postured, for example, to be put in the inside of the conductive shell or to face the outside from the inside of the conductive shell.

Then, when the movable lever is rotated from the first station to the second station under a condition wherein the flat circuit device has been inserted into the housing, the pressure receiving portion of the holding member is pressed up to move by the movable lever so that the engaging projection of the holding member is released from the engagement with the engaging edged portion provided on the flat circuit device inserted in the housing so as not to hold the flat circuit device and the indicating portion of the holding member is shifted from the first position to the second position. The indicating portion taking up the second position is postured, for example, to project from the inside to the outside of the conductive shell.

The indication portion of the holding member taking up the second position to project from the inside to the outside of the conductive shell, as mentioned above, can be visually checked from the outside of the conductive shell.

The movable lever, which is employed in one of the above mentioned embodiments of electrical connector according to the present invention, has the rotating axis portions each supported to be rotatable by the housing and the pressing portion extending from each of the rotating axis portions to be rotatable with the imaginary axis of rotation passing through the rotating axis portions. When the movable lever is rotated from the first station to the second station, the movement of the pressure receiving portion of the holding member pressed up by the movable lever is carried out with the rotation of the pressing portion of the movable lever with the imaginary axis of rotation passing through the rotating axis portions under a condition wherein the pressing portion of the movable lever is in contact with the pressure receiving portion of the holding member The holding member, which is employed in the other of the above mentioned embodiments of electrical connector according to the present invention, is formed with resiliency in the conductive shell. When the engaging projection of the holding member engages with the engaging edged portion provided on the flat circuit device inserted in the housing, the pressure receiving portion of the holding member hits with resilient force against a part of the movable lever, for example, the pressing portion, so as to make a crack of hitting. In addition, an operator who inserts manually the flat circuit device into the housing through the opening provided thereon, can feel a click when the engaging projection of the holding member engages with the engaging edged portion provided on the flat circuit device.

With the electrical connector thus constituted in accordance with the present invention, as described above, when the flat circuit device is inserted into the housing thorough the opening provided thereon under the condition wherein the movable lever is postured to take up the first station, each of the conductive contacts provided to be arranged in the housing comes into press-contact with the corresponding one of the connecting terminals provided on the flat circuit device inserted in the housing and the engaging projection of the holding member formed in the conductive shell engages with the engaging edged portion provided on the flat circuit device inserted in the housing so as to hold the flat circuit device. Accordingly, the flat circuit device inserted in the housing can be surely prevented from getting out of the housing unwillingly by the holding member formed in the conductive shell and the conductive contacts provided in the housing can be stably and appropriately kept in a condition of respective press-contact with the connecting terminals provided on the flat circuit device.

Then, when the movable lever is rotated from the first station to the second station under the condition wherein the flat circuit device has been inserted into the housing, the pressure receiving portion of the holding member is pressed up to move by the movable lever so that the engaging projection of the holding member is released from the engagement with the engaging edged portion provided on the flat circuit device inserted in the housing so as not to hold the flat circuit device. Accordingly, the flat circuit device can be easily and appropriately moved to get out of the housing.

Further, the indicating portion of the holding member is operative to take up the first position to be postured, for example, to be put in the inside of the conductive shell or to face the outside from the inside of the conductive shell when the engaging projection of the holding member formed in the conductive shell engages with the engaging edged portion provided on the flat circuit device inserted in the housing so as to hold the flat circuit device and to take up the second position to be postured, for example, to project from the inside to the outside of the conductive shell when the engaging projection of the holding member is released from the engagement with the engaging edged portion provided on the flat circuit device inserted in the housing so as not to hold the flat circuit device. Then, the indication portion of the holding member taking up the second position to project from the inside to the outside of the conductive shell can be visually checked from the outside of the conductive shell. Accordingly, it can be easily, quickly and accurately confirmed by means of visual check from the outside of the electrical connector that the flat circuit device inserted in the housing has reached an appropriate position in the housing to be surely prevented from getting out of the housing unwillingly by the holding member formed in the conductive shell.

Besides, with the embodiment of electrical connector according to the present invention, in which the holding member is formed with resiliency in the conductive shell, the pressure receiving portion of the holding member hits with resilient force against the part of the movable lever so as to make the crack of hitting when the engaging projection of the holding member engages with the engaging edged portion provided on the flat circuit device inserted in the housing, and the operator who inserts manually the flat circuit device into the housing through the opening provided thereon can feel the click when the engaging projection of the holding member engages with the engaging edged portion provided on the flat circuit device, it can be easily, quickly and accurately confirmed by means of aural check or feeling check from the outside of the electrical connector that the flat circuit device inserted in the housing has reached the appropriate position in the housing to be surely prevented from getting out of the housing unwillingly by the holding member formed in the conductive shell.

The above, and other objects, features and advantages of the present invention will become apparent from the following detailed description taken in conjunction with the accompanying drawings.

DESCRIPTION OF THE PREFERRED EMBODIMENT

Figure 1:
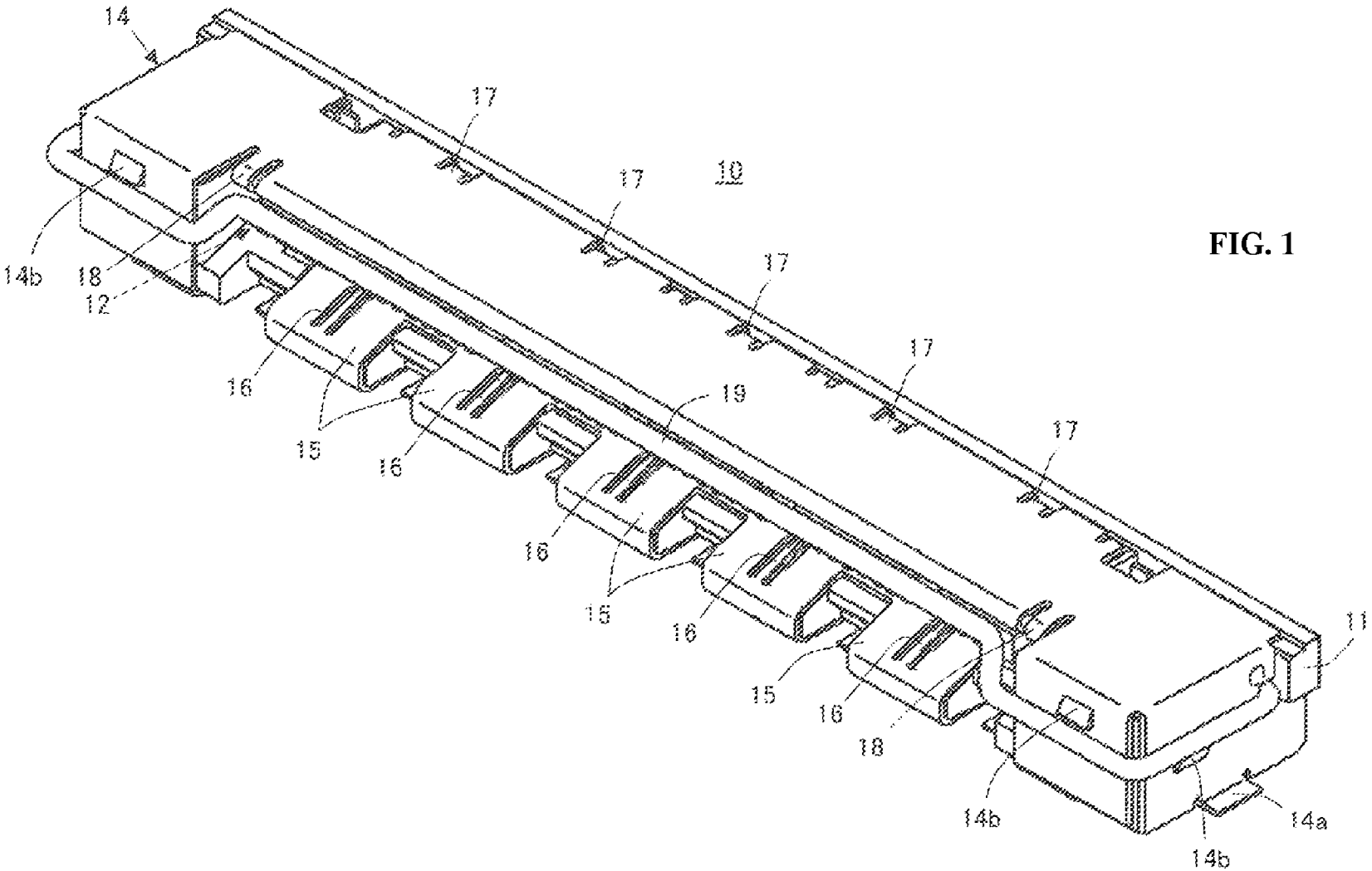
FIGS. 1 and 2 are schematic perspective views each showing an embodiment of electrical connector according to the present invention, in which a movable lever is postured to take up a first station.
Figure 2:
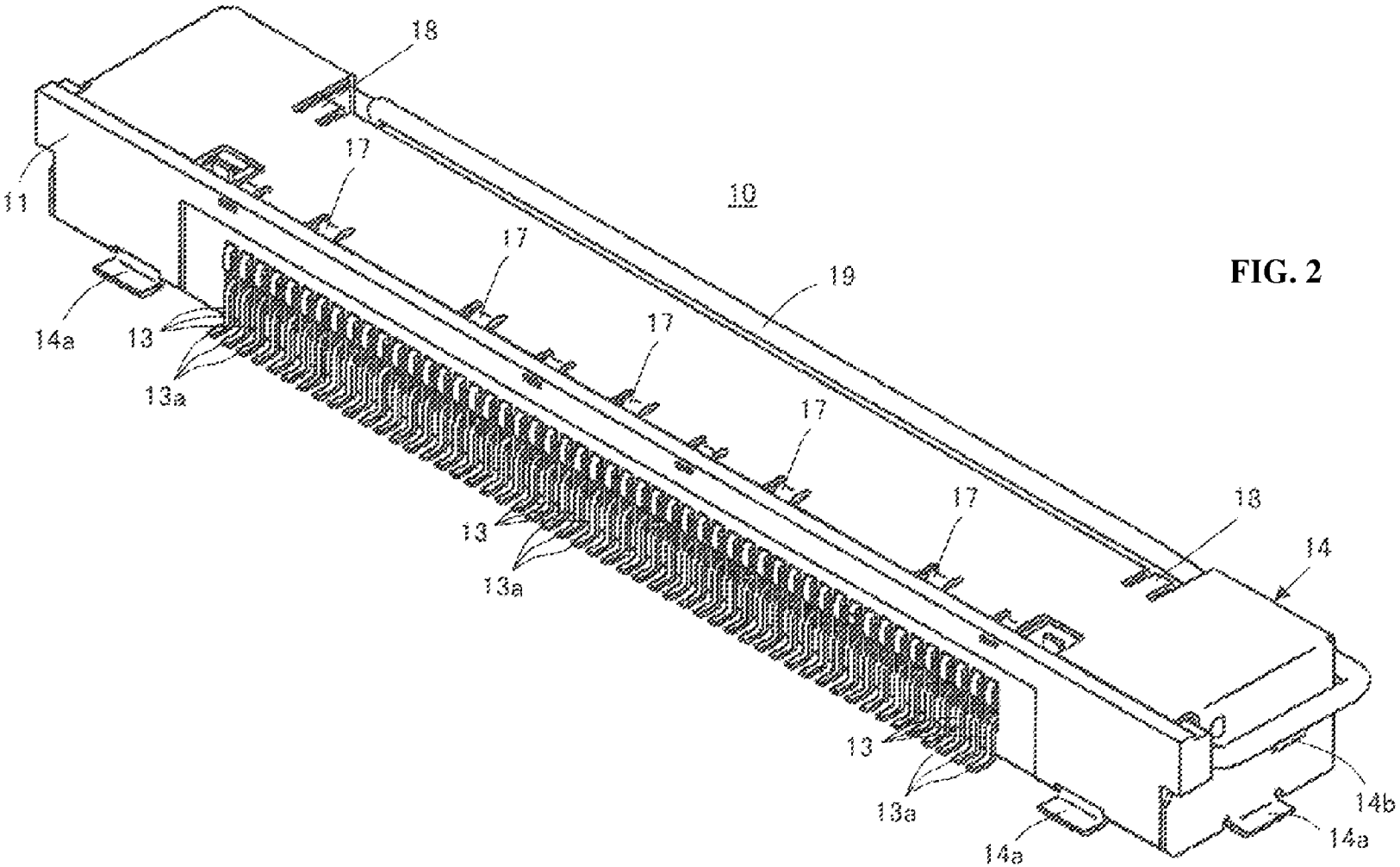
Figure 3:
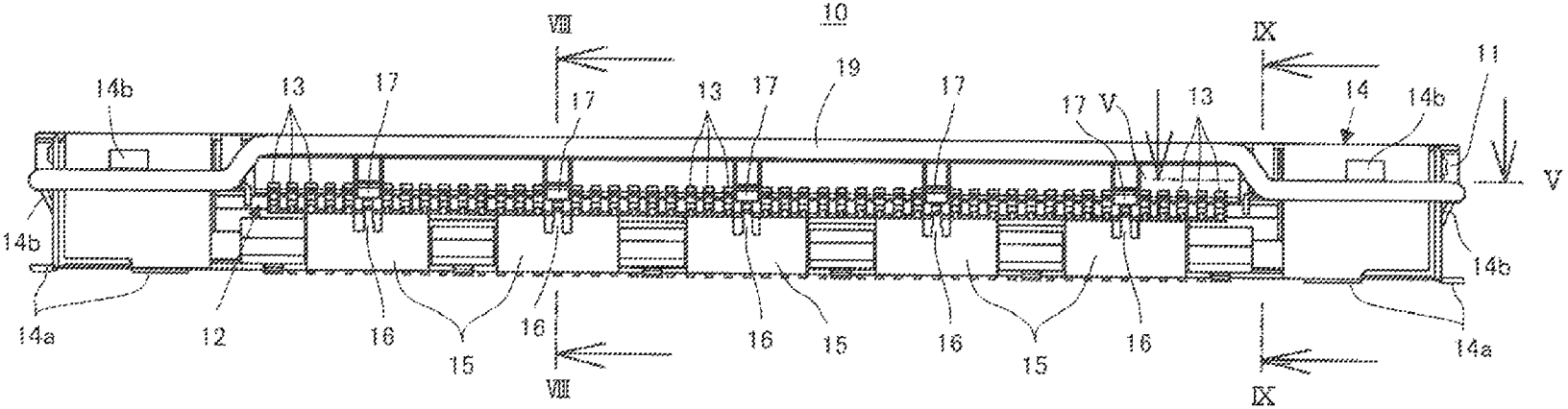
FIG. 3 is a schematic front view showing the embodiment shown in FIGS. 1 and 2, in which the movable lever is postured to take up the first station.

Each of FIG. 1 which is a schematic front, top and right side perspective view, FIG. 2 which is a schematic rear, top and right side perspective view and FIG. 3 which is a front view, shows an embodiment of electrical connector according to the present invention.

Referring to FIGS. 1 to 3, an electrical connector 10, which constitutes the embodiment of electrical connector according to the present invention, has a housing 11 made of insulator such as plastics or the like.

When the electrical connector 10 is put in practical use, the housing 11 is mounted on a main solid circuit board in an electronic apparatus (not shown in the drawings) so that the electrical connector 10 is fixed in its entirety to the main solid circuit board.

The housing 11 is provided with an opening 12 through which, for example, an FPC constituting a flat circuit device is inserted into the housing 11.

A plurality of conductive contacts 13, each of which is made of resilient conductive material, are provided on the housing 11 of the electrical connector 10 to be arranged in a longitudinal direction of the housing 11. Each of the conductive contacts 13 constitutes, for example, a signal contact operative to come into press-contact with a signal connecting terminal provided on the FPC. It is also possible that the conductive contacts 13 include, in addition to the signal contacts, one or more ground contacts operative to come into press-contact with a ground connecting portion provided on the FPC. Further, each of the conductive contact 13 has a connecting terminal 13*a* projecting from a rear end portion of the housing 11 to the outside thereof, as shown in FIG. 2. The connecting terminal 13*a* of the conductive contact 13 is connected electrically with a signal terminal provided on the main solid circuit board on which the housing 11 is mounted. These conductive contacts 13 are, for example, thrust into the housing 11 from the rear end portion thereof shown in FIG. 2 when the electrical connector 10 is assembled.

When the FPC is inserted into the housing through the opening 12 provided thereon, the conductive contacts 13 come into press-contact with the signal connecting terminals provided on the FPC inserted in the housing 11, respectively. Therefore, the signal connecting terminals provided on the FPC inserted in the housing 11 are electrically connected through the conductive contacts 13 with the signal terminals provided on the main solid circuit board on which the housing 11 is mounted.

The electrical connector 10 has also a conductive shell 14 mounted on the housing for covering an outer surface of the housing except the rear end portion, portions in the vicinity of the rear end portion and a part of a bottom portion thereof. That is, the conductive shell 14 is provided for covering partially the housing 11. An upper portion of the conductive shell 14 opposite to the bottom portion of the housing 11 covers over a space in the housing 11 connected with the opening 12 provided on the housing 11. The conductive shell 14 is formed by means of processing a metal thin plate and grounded to be operative to shield the conductive contacts 13 on the housing 11 from electromagnetic wave noises coming from the outside. A plurality of ground connecting terminals 14*a* are formed in the conductive shell 14 to be connected electrically with a grounded portion provided on the main solid circuit board on which the housing 11 is mounted.

The conductive shell 14 is provided with a plurality of slanted guiding portions 15 formed therein, each of which extends from a lower portion of the conductive shell 14 covering partially the outer surface of the bottom portion of the housing 11 so as to form a slanted surface in the vicinity of the opening 12 provided on the housing 11, a plurality of first grounding contacts 16 formed therein, each of which constitutes a part of the slanted guiding portion 15, and a plurality of second grounding contacts 17 formed therein, each of which extends from a rear end of the upper portion of the conductive shell 14 covering over the space in the housing 11 connected with the opening 12 provided on the housing 11 into the inside of the housing 11 in the direction toward the opening 12.

The slanted guiding portion 15 is operative to guide with the slanted surface the FPC inserted through the opening 12 into the housing 11. The first grounding contact 16 is operative to come into press-contact with the ground connecting portion provided on the FPC inserted in the housing 11 from the side of the lower portion of the conductive shell 14 to be connected electrically with the ground connecting portion provided on the FPC. The second grounding contact 17 is operative to come into press-contact with the ground connecting portion provided on the FPC inserted in the housing 11 from the side of the upper portion of the conductive shell 14 to be connected electrically with the ground connecting portion provided on the FPC.

In the case where the FPC inserted in the housing 11 is not provided with the ground connecting portion on a part thereof opposite to the upper portion of the conductive shell 14 but provided with the ground connecting portion only on another part thereof opposite to the lower portion of the conductive shell 14, the first grounding contact 16 provided on the conductive shell 14 is operative to come into contact with the part of the FPC opposite to the upper portion of the conductive shell 14 and the second grounding contact 17 provided on the conductive shell 14 is operative to come into contact with the ground connecting portion provided on the part of the FPC opposite to the lower portion of the conductive shell 14. Further, in the case where the FPC inserted in the housing 11 is not provided with the ground connecting portion on a part thereof opposite to the lower portion of the conductive shell 14 but provided with the ground connecting portion only on another part thereof opposite to the upper portion of the conductive shell 14, the second grounding contact 17 provided on the conductive shell 14 is operative to come into contact with the part of the FPC opposite to the lower portion of the conductive shell 14 and the first grounding contact 16 provided on the conductive shell 14 is operative to come into contact with the ground connecting portion provided on the part of the FPC opposite to the upper portion of the conductive shell 14.

With the first and second grounding contacts 16 and 17 thus described, the ground connecting portions provided on the FPC inserted in the housing 11 are electrically connected through the conductive shell 14 with the grounded portion provided on the main solid circuit board on which the housing 11 is mounted.

The conductive shell 14 is also provided with a pair of holding members 18 for holding the FPC inserted in the housing 11 through the opening 12 provided thereon. The holding members 18 are formed in a body in the conductive shell 14 respectively at portions in the vicinity of a pair of end portions of the conductive shell 14 opposite each other in the longitudinal direction of the housing 11 along which the conductive contacts 13 are arranged. Each of the holding members 18 extends first from a front end of the upper portion of the conductive shell 14 covering over the space in the housing 11 connected with the opening 12 provided on the housing 11 to the space in the housing 11 and then from the space in the housing 11 toward the outside of the conductive shell 14. The holding members 18 for holding the FPC inserted in the housing 11 through the opening 12 provided thereon are operative to prevent the FPC inserted in the housing 11 from getting out of the housing 11 unwillingly, as described in detail later.

Figure 4:
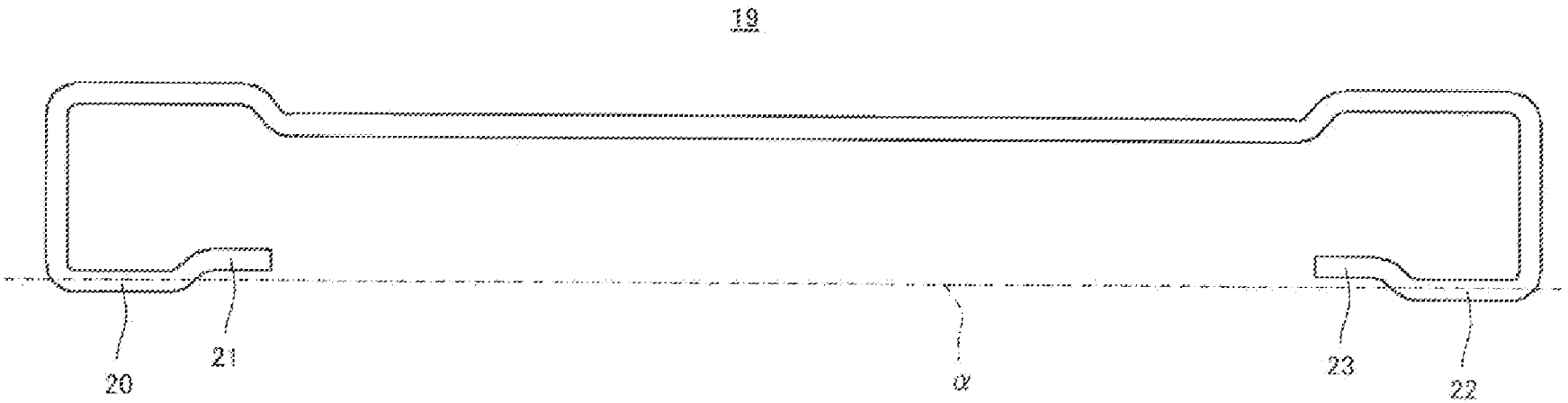
FIG. 4 is a schematic plan view showing the movable lever employed in the embodiment shown in FIGS. 1 and 2.

The electrical connector 10 has further a movable lever 19 provided to be rotatable to the housing 11, in addition to the housing 11, the conductive contacts 13 and the conductive shell 14. The movable lever 19 is formed, for example, by means of bending a metal bar to have a pair of ends folded back to be opposite each other, as shown in FIG. 4. A pair of rotating axis portions 20 and 22 are provided respectively on the ends of the movable lever 19 folded back to be opposite each other. The rotating axis portion 20 is supported to be rotatable by the housing 11 and a top end extending to be winding from the rotating axis portion 20 forms a pressing portion 21 which is rotatable with an imaginary axis of rotation $\alpha$ passes through the rotating axis portions 20 and 22, as shown with a broken line in FIG. 4. The rotating axis portion 22 is also supported to be rotatable by the housing 11 and a top end extending to be winding from the rotating axis portion 22 forms a pressing portion 23, which is rotatable with the imaginary axis of rotation α passing through the rotating axis portions 20 and 22. Accordingly, the movable lever 19 has the rotating axis portion 20 supported to be rotatable by the housing 11 and the pressing portion 21 extending to be winding from the rotating axis portion 20 to be rotatable with the same on one of the ends thereof folded back to be opposite each other and the rotating axis portion 22 supported also to be rotatable by the housing 11 and the pressing portion 23 extending to be winding from the rotating axis portion 22 to be rotatable with the same on the other of the ends thereof folded back to be opposite each other.

Figure 5:
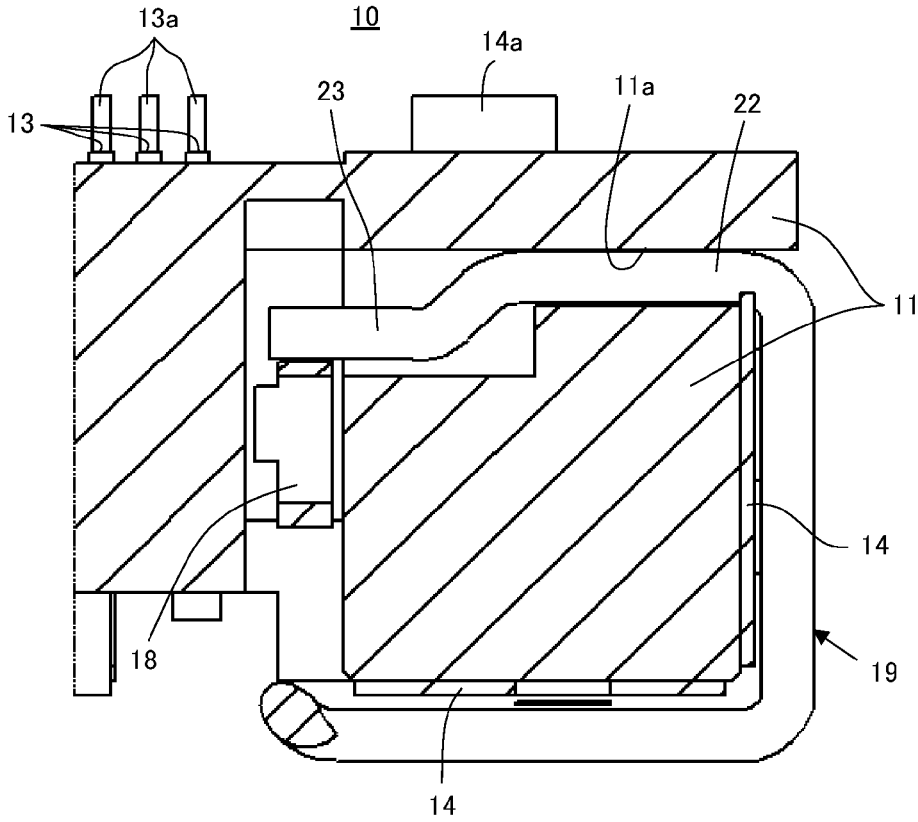
FIG. 5 is a schematic cross sectional view taken along line V-V on FIG. 3.

As shown in FIG. 5 which is a schematic cross sectional view taken along line V-V on FIG. 3, the rotating axis portion 22 of the movable lever 19 is supported to be rotatable by a bearing portion 11*a* provided on one of end portions of the housing 11 in the longitudinal direction. Further, although there is no any illustration, the rotating axis portion 20 of the movable lever 19 is supported to be rotatable by a bearing portion corresponding to the bearing portion 11*a* provided on the other of the end portions of the housing 11 in the longitudinal direction.

Accordingly, the movable lever 19 is operative to be rotated in its entirety in regard to the housing 11 with the imaginary axis of rotation α passing through the rotating axis portions 20 and 22. When the movable lever 19 is rotated in regard to the housing 11, each of the pressing portions 21 and 23 of the movable lever 19 moves round the imaginary axis of rotation α passing through the rotating axis portions 20 and 22

Figure 6:
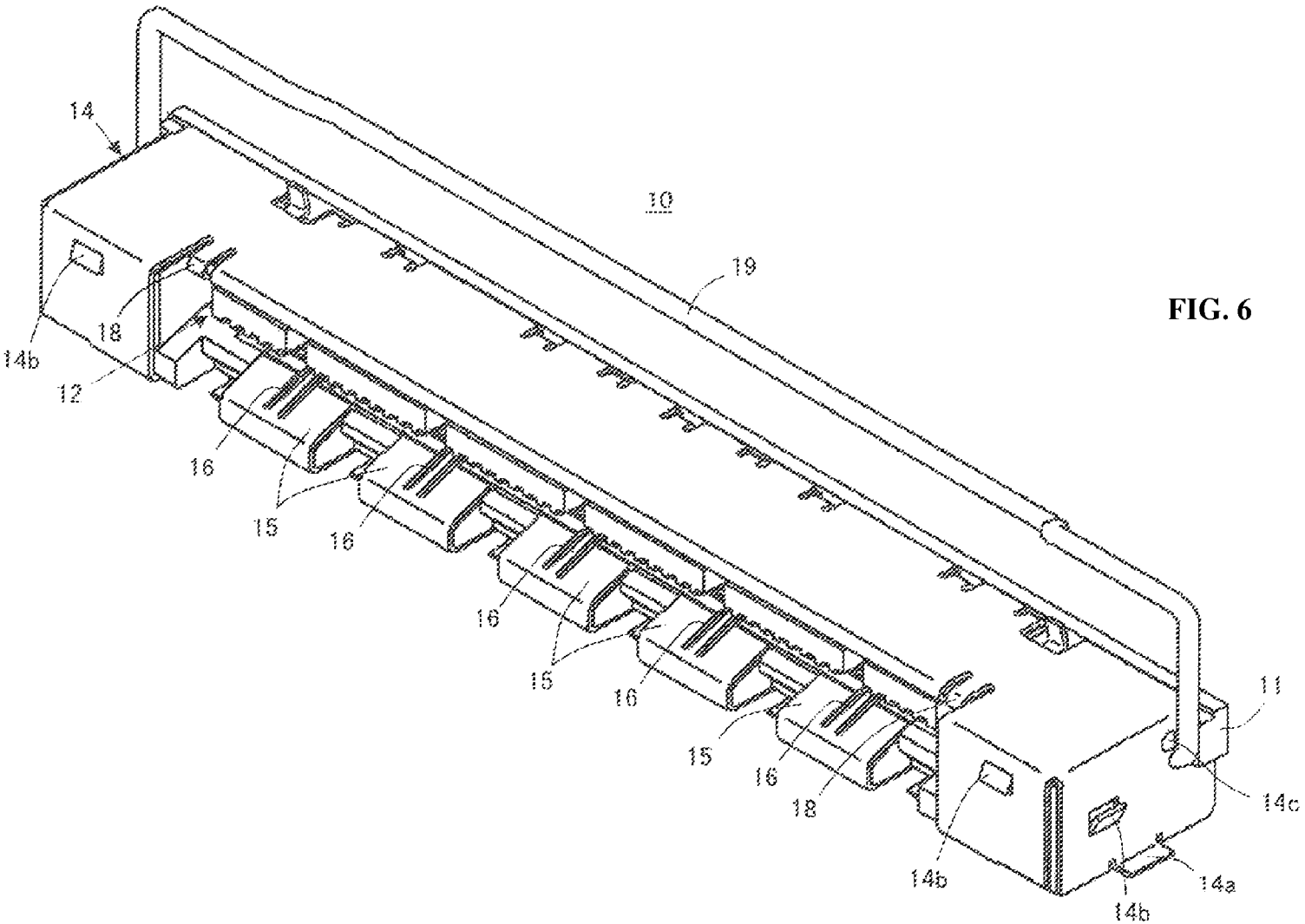
FIGS. 6 and 7 are schematic perspective views each showing the embodiment shown in FIGS. 1 and 2, in which the movable lever is postured to take up a second station.
Figure 7:
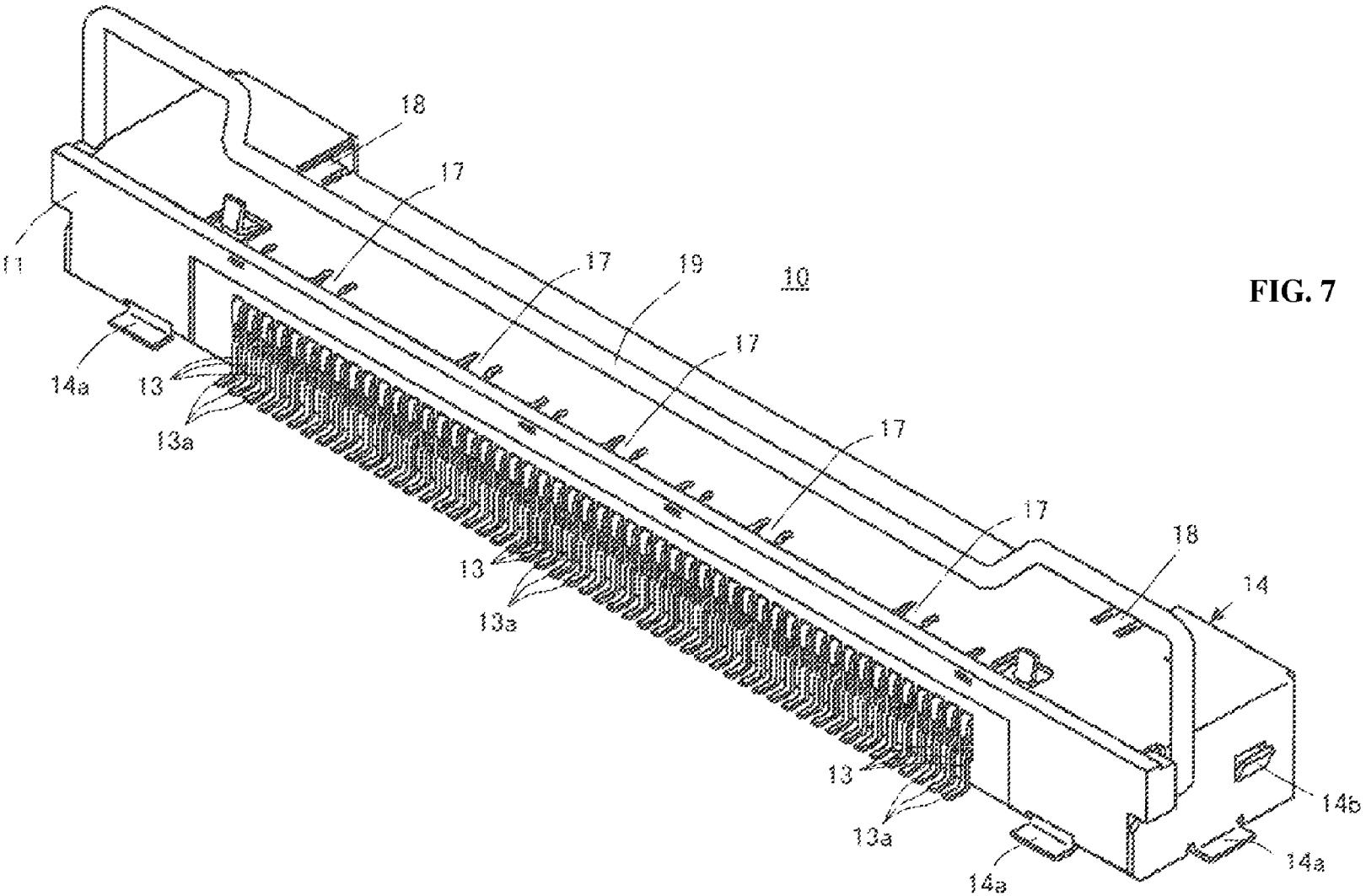

The movable lever 19 rotatable in regard to the housing 11 is postured to take up selectively a first station wherein the movable lever 19 is positioned in its entirety to keep lying down on the housing 11, as shown in FIGS. 1 to 3, and a second station wherein the movable lever 19 is positioned in its entirety to keep rising from the housing 11, as shown in FIGS. 6 and 7. The movable lever 19 postured to take up the first station is held by a plurality of holding projections 14*b* provided on the conductive shell 14 as shown in FIG. 1 and the movable lever 19 postured to take up the second station is held by a holding projection 14*c* provided on the conductive shell 14 as shown in FIG. 6. To be more concrete, the movable lever 19 postured to take up the first station is put between the holding projections 14*b* provided respectively on a front end portion and a side end portion of the conductive shell 14 and comes into press-contact with the holding projections 14*b* provided on the side end portion of the conductive shell 14 so as to be prevented from rotating further toward the main solid circuit board on which the housing 11 is mounted, and the movable lever 19 postured to take up the second station is put between the holding projections 14*c* provided on the side end portion of the conductive shell 14 and the housing 11 and comes into press-contact with the housing 11 so as to be prevented from rotating further to be remote from the main solid circuit board on which the housing 11 is mounted.

Figure 8:
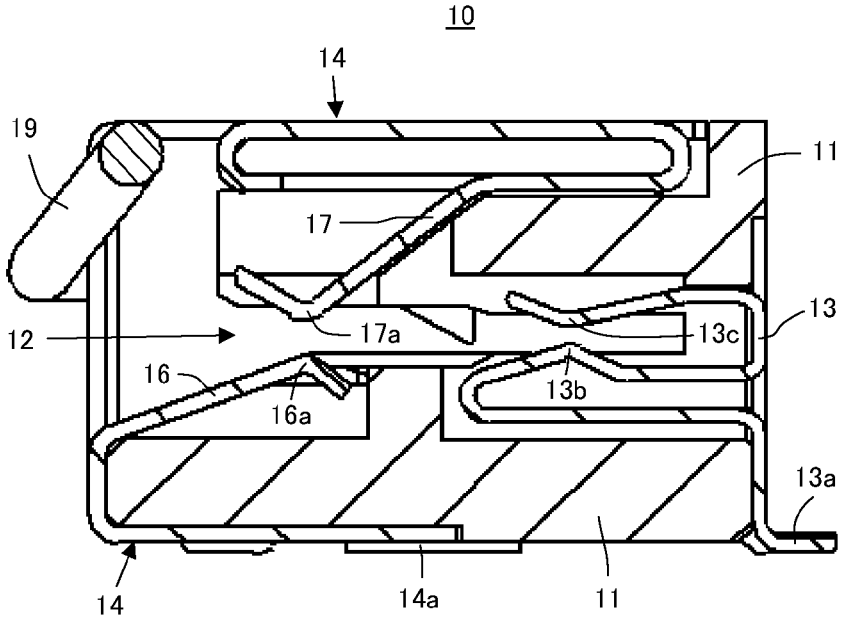
FIG. 8 is a schematic cross sectional view taken along line VIII-VIII on FIG. 3.

In FIG. 8 which is a schematic cross sectional view taken along line VIII-VIII on FIG. 3, the conductive contact 13 provided on the housing 11 and the first and second grounding contacts 16 and 17 both provided on the conductive shell 14 are shown.

Referring to FIG. 8, the conductive contact 13 has a part thereof which forms a adversely S-shaped cross section in the housing 11. A lower contacting portion 13*b* and an upper contacting portion 13*c* facing the lower contacting portion 13*b* are formed on the part the conductive contact 13 forming the adversely S-shaped cross section in the housing 11. The lower contacting portion 13*b* is operative to come into press-contact with the signal connecting terminal or a portion other than the signal connecting terminal provided on the FPC inserted in the housing 11 from the side of the lower portion of the conductive shell 14. The upper contacting portion 13*c* is operative to come into press-contact with a portion other than the signal connecting terminal or the signal connecting terminal provided on the FPC from the side of the upper portion of the conductive shell 14.

A contacting portion 16*a* is formed on the first grounding contact 16 extending from the lower portion of the conductive shell 14 into the housing 11. The contacting portion 16*a* formed on the first grounding contact 16 is operative to come into press-contact with the ground connecting portion or a portion other than the ground connecting portion provided on the FPC inserted in the housing 11 from the side of the lower portion of the conductive shell 14.

A contacting portion 17*a* is formed on the second grounding contact 17 extending from the upper portion of the conductive shell 14 into the housing 11. The contacting portion 17*a* formed on the second grounding contact 17 is positioned to face the contacting portion 16*a* formed on the first grounding contact 16 and operative to come into press-contact with a portion other than the ground connecting portion or the ground connecting portion provided on the FPC inserted in the housing 11 from the side of the upper portion of the conductive shell 14.

Figure 9:
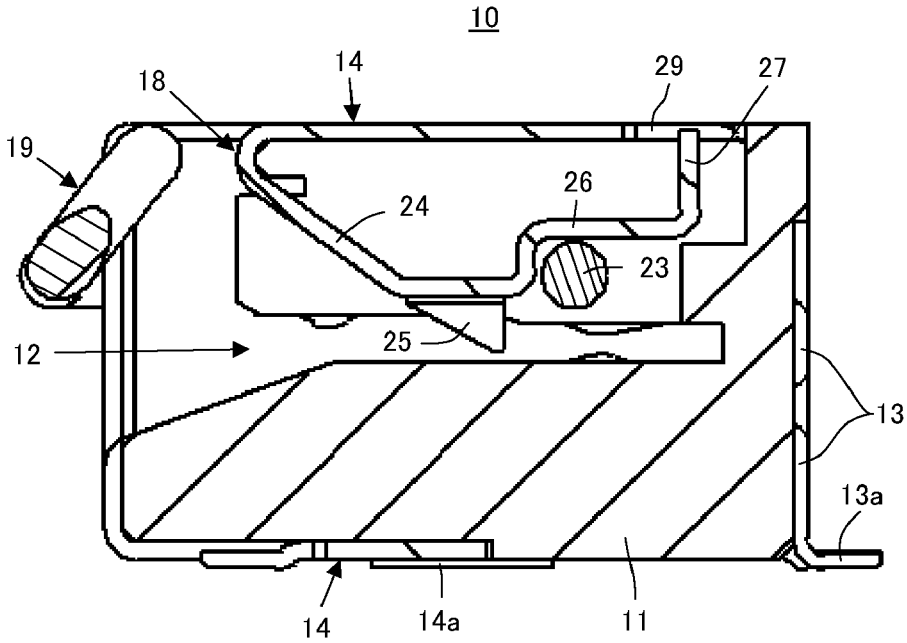
FIG. 9 is a schematic cross sectional view taken along line IX-IX on FIG. 3.

In FIG. 9 which is a schematic cross sectional view taken along line IX-IX on FIG. 3, the holding member 18 formed in a body in the conductive shell 14 is shown.

Referring to FIG. 9, the holding member 18 formed in the conductive shell 14 comprises an arm portion 24 which extends from the front end of the upper portion of the conductive shell 14 to the inside of the conductive shell 14, an engaging projection 25 which is provided at an end of the arm portion 24 to be positioned in the inside of the conductive shell 14 for engaging with an engaging edged portion provided on the FPC inserted in the housing 11, as described later, a pressure receiving portion 26 which extends from the engaging projection 25 to be positioned in the inside of the conductive shell 14 for receiving pressure from the pressing portion 23 (or the pressing portion 21) of the movable lever 19, and an indicating portion 27 which extends from the pressure receiving portion 26 toward the outside of the upper portion of the conductive shell 14 for indicating a state of the holding member 18. The indicating portion 27 has a top end thereof and is postured to take up selectively first and second positions. When the indicating portion 27 is postured to take up the first position, the top end of the indicating portion 27 is positioned to face the outside of the conductive shell 14 through an opening 29 formed in the upper portion of the conductive shell 14. When the indicating portion 27 is postured to take up the second position, the top end of the indicating portion 27 is positioned to project from the inside to the outside of the conductive shell 14 through the opening 29 formed in the upper portion of the conductive shell 14.

Figure 10:
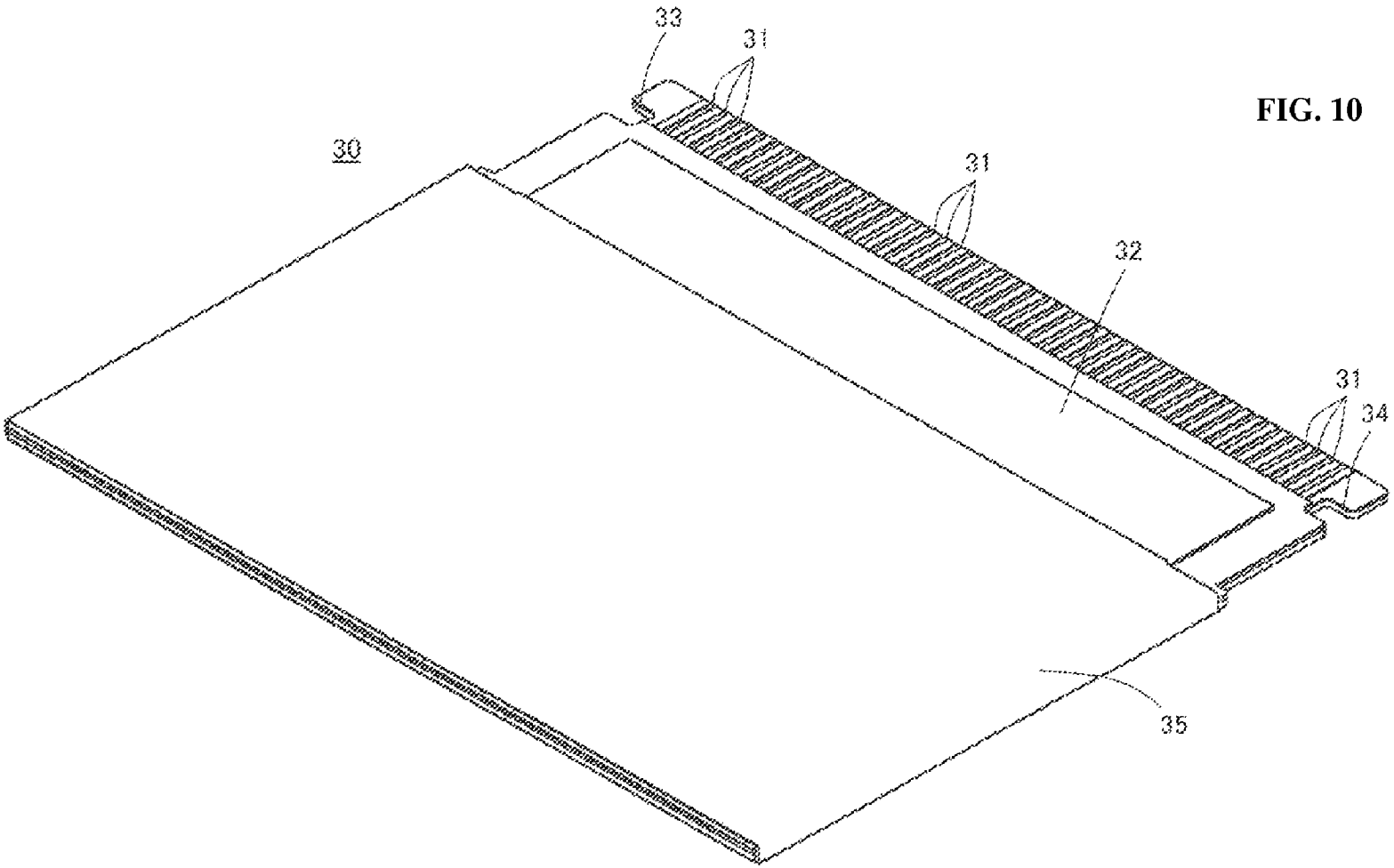
FIG. 10 is a schematic perspective view showing an FPC which is to be inserted into a housing of the embodiment shown in FIGS. 1 and 2.

FIG. 10 shows an FPC 30 which is an example of the FPC constituting the flat circuit device to be inserted into the housing 11 of the electrical connector 10 through the opening 12 provided on the housing 11.

Referring to FIG. 10, a plurality of signal connecting terminals 31 each made of conductive material and formed into a rectangular plate member are provided to be arranged on one of a pair of surfaces opposite each other of the FPC 30. A ground connecting portion 32 is also provided on the surface of the FPC 30 on which the signal connecting terminals 31 are provided at the outside of the ground connecting portion 32. Further, a pair of engaging edged recesses 33 and 34 are provided respectively on side end portions of the FPC 30 which are opposite each other with the signal connecting terminals 31 and the ground connecting portion 32 between. It is possible to provide the FPC with a pair of engaging edged holes in place of the engaging edged recesses 33 and 34. The FPC 30 is wrapped with a covering film 35 except a portion thereof on which the signal connecting terminals 31, a part of the ground connecting portion 32 and the engaging edged recesses 33 and 34 are provided.

Although the FPC 30 shown in FIG. 10 is provided with the signal connecting terminals 31 and the ground connecting portion 32 on one of the surfaces thereof opposite each other, it is also possible to use an FPC which is provided with a plurality of signal connecting terminals corresponding to the signal connecting terminals 31 on one of first and second surfaces opposite each other and with a ground connecting portion corresponding to the ground connecting portion 32 on the other of the first and second surfaces, as the flat circuit device provided to be inserted into the housing 11.

Figure 11:
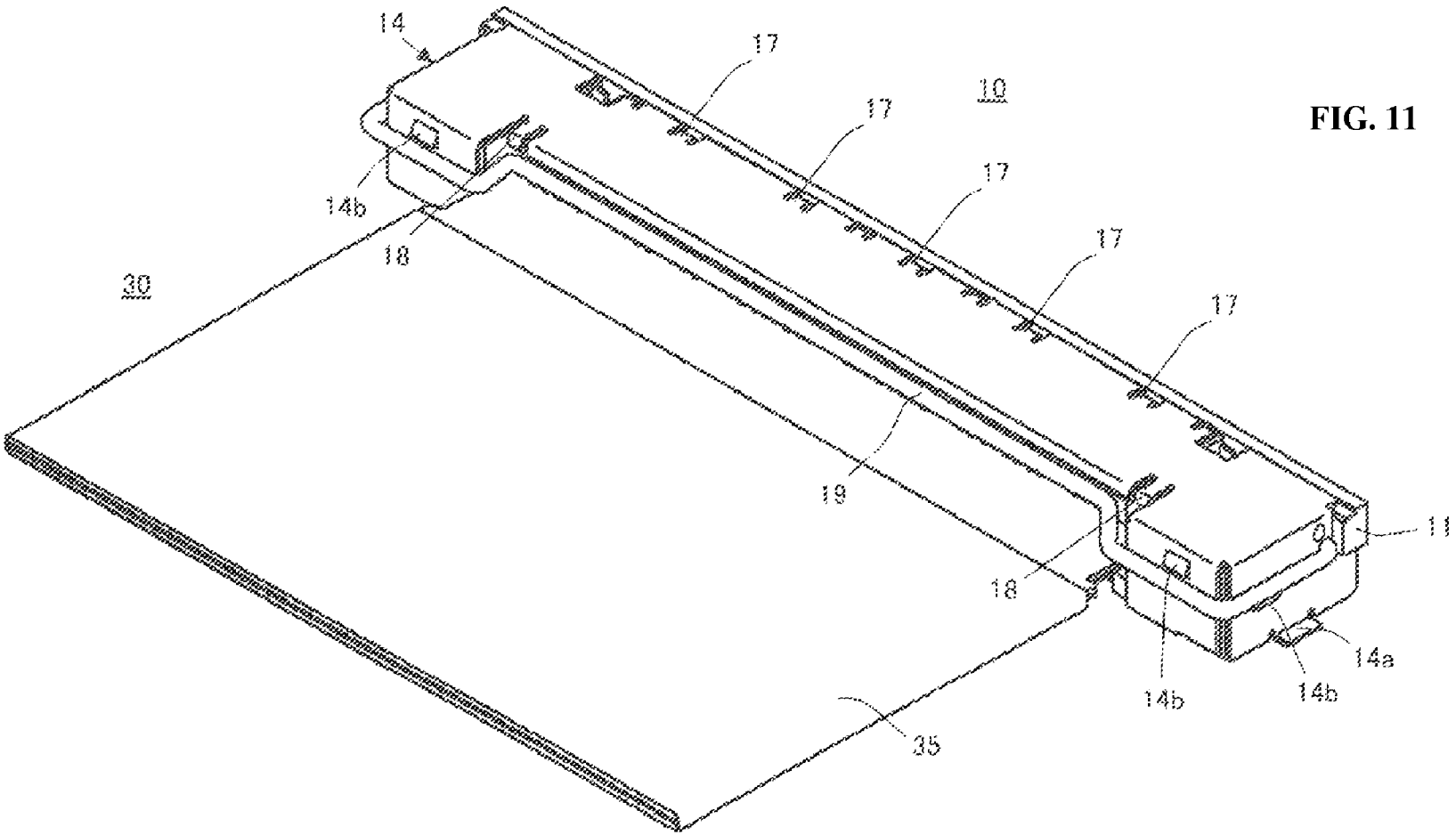
FIG. 11 is a schematic perspective view showing the embodiment shown in FIGS. 1 and 2 and the FPC which is inserted in the housing of the embodiment.

FIG. 11 shows the electrical connector 10 and the FPC 30 which is inserted in the housing 11 of the electrical connector 10 through the opening 12 provided on the housing 11 under a condition wherein the movable lever 19 of the electrical connector 10 is postured to take up the first station. In FIG. 11, the other of the surfaces opposite each other of the FPC 30, on which any signal connecting terminal is not provided, is shown.

When the FPC 30 is inserted in the housing 11 of the electrical connector 10 through the opening 12 provided on the housing 11, as shown in FIG. 11, the lower contacting portion 13*b* of each of the conducting contacts 13 arranged in the housing 11 comes into press-contact with a corresponding one of the signal connecting terminals 31 provided on the FPC 30 inserted in the housing 11 from the side of the lower portion of the conductive shell 14. As a result, the signal connecting terminals 31 provided on the FPC 30 inserted in the housing 11 are electrically connected through the conducting contacts 13 with the signal terminals provided on the main solid circuit board on which the housing 11 is mounted.

On that occasion, the upper contacting portion 13*c* of each of the conducting contacts 13 arranged in the housing 11 also comes into press-contact with a corresponding portion other than the signal connecting terminal 31 of the FPC 30 inserted in the housing 11 from the side of the upper portion of the conductive shell 14. As a result, the FPC 30 inserted in the housing 11 is put between the lower contacting portion 13*b* of each of the conducting contacts 13 and the upper contacting portion 13*c* of each of the conducting contacts 13, so that the pressure acting upon the FPC 30 from the lower contacting portion 13*b* of each of the conducting contacts 13 and the pressure acting upon the FPC 30 from the upper contacting portion 13*c* of each of the conducting contacts 13 are cancelled with each other and the housing 11 is prevented from receiving undesirable stress from the conductive contacts 13. That is, it can be avoided that undesirable deformation of the housing 11 is caused by the stress from the conducting contacts 13.

Further, the contacting portion 16*a* of each of the first grounding contacts 16 extending from the lower portion of the conductive shell 14 into the housing 11 comes into press-contact with the ground connecting portion 32 provided on the FPC 30 inserted in the housing 11 from the side of the lower portion of the conductive shell 14. As a result, the ground connecting portion 32 provided on the FPC 30 inserted in the housing 11 is electrically connected through the first grounding contacts 16 with the grounded portion provided on the main solid circuit board on which the housing 11 is mounted.

On that occasion, the contacting portion 17*a* of each of the second grounding contacts 17 extending from the upper portion of the conductive shell 14 into the housing 11 also comes into press-contact with a portion other than the ground connecting portion 32 of the FPC 30 inserted in the housing 11 from the side of the upper portion of the conductive shell 14. As a result, the FPC 30 inserted in the housing 11 is put between the contacting portion 16*a* of each of the first grounding contacts 16 and the contacting portion 17*a* of each of the second grounding contacts 17, so that the pressure acting upon the FPC 30 from the contacting portion 16*a* of each of the first grounding contacts 16 and the pressure acting upon the FPC 30 from the contacting portion 17*a* of each of the second grounding contacts 17 are cancelled with each other and the housing 11 is prevented from receiving undesirable stress from the first and second grounding contacts 16 and 17. That is, it can be avoided that undesirable deformation of the housing 11 is caused by the stress from the first and second grounding contacts 16 and 17.

Figure 12:
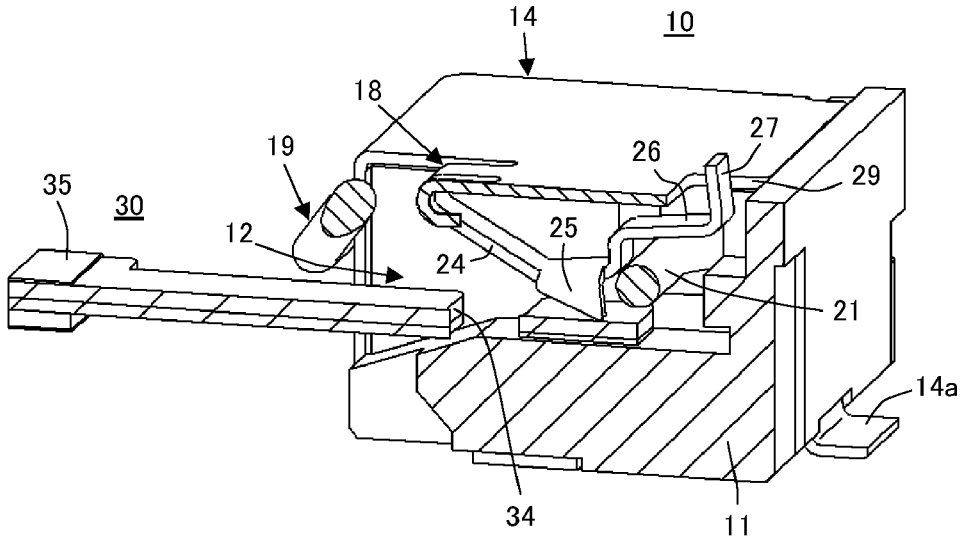
FIG. 12 is a schematic partial perspective view including a partial cross sectional view for showing the embodiment shown in FIGS. 1 and 2 and the FPC which is put on the way to be inserted into the housing of the embodiment.

When the FPS 30 is inserted into the housing 11 of the electrical connector 10 through the opening 12 provided on the housing 11 under the condition wherein the movable lever 19 of the electrical connector 10 is postured to take up the first station, first the engaging projection 25 of one of the holding members 18 extending from the upper portion of the conductive shell 14 comes into contact with an end portion of the FPC 30 extending forward from the engaging edged recess 34 provided on the FPC 30 from the side of the upper portion of the conductive shell 14, as shown in FIG. 12. At this time, the holding member 18 is resiliently deformed so as to shift entirely the arm portion 24, the engaging projection 25, the pressure receiving portion 26 and the indicating portion 27 toward the upper portion of the conductive shell 14 and the indicating portion 27 is caused to take up the second position with the top end thereof positioned to project from the inside to the outside of the conductive shell 14 through the opening 29 formed in the upper portion of the conductive shell 14.

Figure 13:
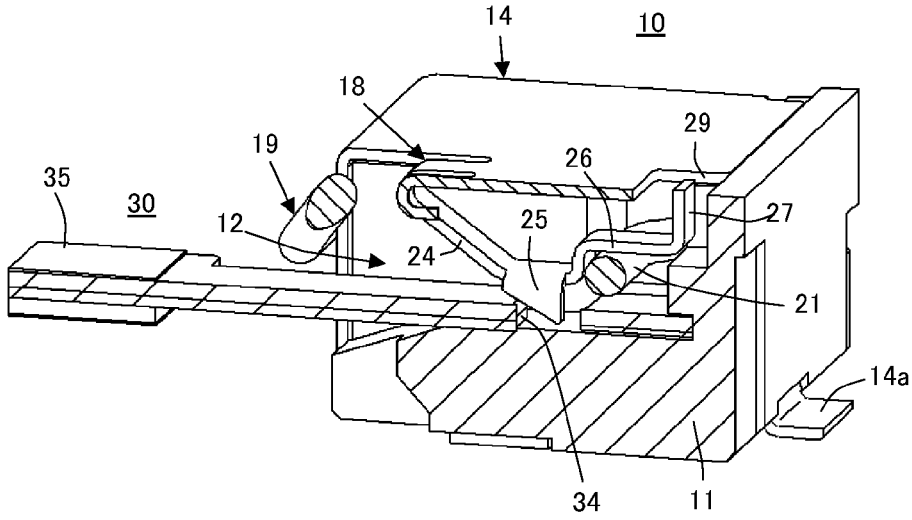
FIG. 13 is a schematic partial perspective view including a partial cross sectional view for showing the embodiment shown in FIGS. 1 and 2 and the FPC which has been inserted in the housing of the embodiment and held by a holding member provided in the housing.

Then, the FPC 30 is further inserted in the housing 11 to reach a predetermined appropriate position in the housing 11. When the FPC 30 has reached the appropriate position in the housing 11, the engaging projection 25 of the holding member 18 extending from the upper portion of the conductive shell 14 engages with the engaging edged recess 34 provided on the FPC 30, as shown in FIG. 13. At that time, the holding member 18 is restored to its condition prior to resilient deformation so that a front slanted portion of the engaging projection 25 of the holding member 18 hits with resilient force against an edge on the FPC 30 forming the engaging edged recess 34 and the pressure receiving portion 26 of the holding member 18 also hits with resilient force against the pressing portion 21 of the movable lever 19 taking up the first station. As a result, a crack of hitting is made when the pressure receiving portion 26 of the holding member 18 hits with resilient force against the pressing portion 21 of the movable lever 19. In addition, an operator who inserts manually the FPC 30 into the housing 11 through the opening 12 provided thereon can feel a click when the engaging projection 25 of the holding member 18 engages with the engaging edged recess 34 provided on the FPC 30. Accordingly, the engagement of the engaging projection 25 of the holding member 18 with the engaging edged recess 34 provided on the FPC 30 can be easily confirmed by means of aural check or feeling check from the outside of the conductive shell 14.

Further, the indicating portion 27 of the holding member 18 is postured to take up the first position with the top end thereof positioned to face the outside of the conductive shell 14 through the opening 29 formed in the upper portion of the conductive shell 14, as shown in FIG. 13, when the engaging projection 25 of the holding member 18 engages with the engaging edged recess 34 provided on the FPC 30. Accordingly, it can be easily confirmed by checking visually the indicating portion 27 of the holding member 18 from the outside of the conductive shell 14 that the FPC 30 has reached the appropriate position in the housing 11 and the engaging projection 25 of the holding member 18 engages with the engaging edged recess 34 provided on the FPC 30. It is possible to position the indicating portion 27 of the holding member 18 in its entirety at the inside of the conductive shell 14.

The engaging projection 25 of the other of the holding members 18 extending from the upper portion of the conductive shell 14 engages also with the engaging edged recess 33 provided on the FPC 30 in the same manner as the case of the engaging edged recess 34 provided on the FPC 30 and the pressure receiving portion 26 of the holding member 18 hits with resilient force against the pressing portion 23 of the movable lever 19 taking up the first station when the FPC 30 inserted in the housing 11 has reached the appropriate position in the housing 11.

Under a condition wherein the engaging projections 25 of the holding members 18 engage respectively with the engaging edged recesses 33 and 34 provided on the FPC 30, the front slanted portion of each of the engaging projections 25 which is in press-contact with the edge on the FPC 30 forming the engaging edged recess 33 or 34 is operative to press the FPC 30 down against the bottom portion of the housing 11 so as to fix the FPC 30 vertically in the housing 11. Further, the end portion of the FPC 30 extending forward from each of the engaging edged recesses 33 and 34 provided on the FPC 30 is put in contact with a part of an inner surface of the housing 11 and thereby the FPC 30 inserted in the housing 11 is fixed in a direction of insertion thereof. With the holding members 18 having the engaging projections 25 which engage respectively with the engaging edged recesses 33 and 34 provided on the FPC in such a manner as mentioned above, the FPC 30 is held in the housing 11 so as to be prevented from getting out from the housing 11 unwillingly.

After that, when the movable lever 19 is rotated in regard to the housing 11 with the imaginary axis of rotation α passing through the rotating axis portions 20 and 22 to shift from the first station to the second station, each of the pressing portions 21 and 23 of the movable lever 19 moves round the imaginary axis of rotation α passing through the rotating axis portions 20 and 22 so as to shift the pressure receiving portion 26 of each of the holding members 18 toward the upper portion of the conductive shell 14.

Figure 14:
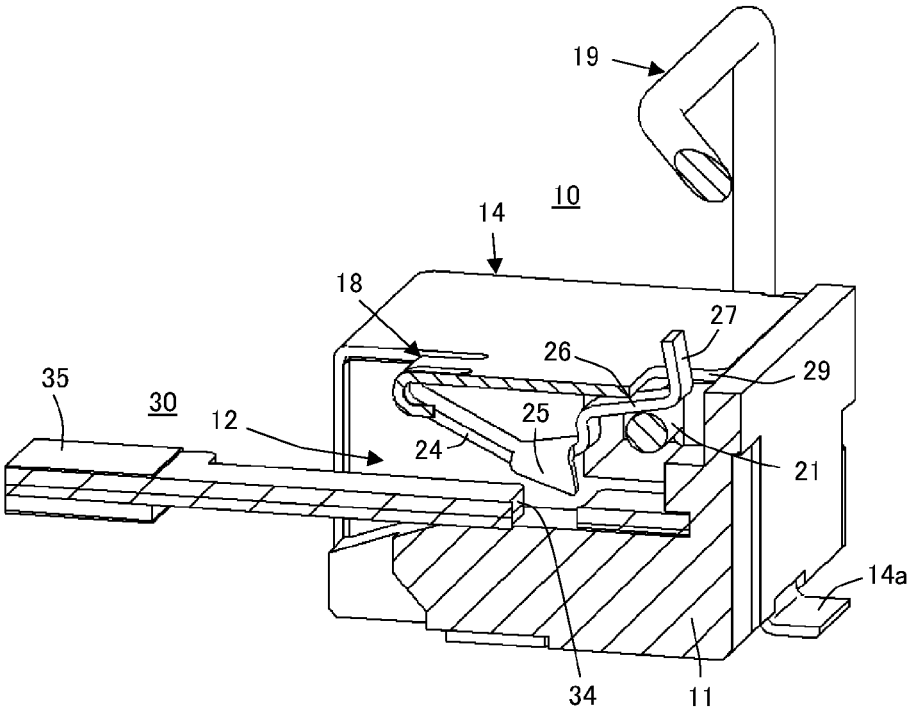
FIG. 14 is a schematic partial perspective view including a partial cross sectional view for showing the embodiment shown in FIGS. 1 and 2 and the FPC which is released from holding by the holding member provided in the housing of the embodiment.

When the movable lever 19 is postured to take up the second station, the pressing portion 21 of the movable lever 19 is operative to position the pressure receiving portion 26 of the holding member 18 to be close extremely to the upper portion of the conductive shell 14, as shown in FIG. 14, and thereby the holding member 18 is resiliently deformed so as to shift the engaging projection 25 to be released from the engagement with the engaging edged recess 34 provided on the FPC 30.

Further, at that time, the indicating portion 27 of the holding member 18 deformed resiliently is postured to take up the second position with the top end thereof positioned to project from the inside to the outside of the conductive shell 14 through the opening 29 formed in the upper portion of the conductive shell 14. As a result, it can be easily confirmed by checking visually the indicating portion 27 of the holding member 18 from the outside of the conductive shell 14 that the engaging projection 25 of the holding member 18 disengages from the engaging edged recess 34 provided on the FPC 30.

In addition, when the movable lever 19 is rotated in regard to the housing 11 with the imaginary axis of rotation α passing through the rotating axis portions 20 and 22 to shift from the first station to the second station under the condition wherein the FPC 30 has been inserted in the housing 11 through the opening 12 provided thereon, the pressing portion 23 of the movable lever 19 is operative also to position the pressure receiving portion 26 of the holding member 18 to be close extremely to the upper portion of the conductive shell 14 and thereby the holding member 18 is resiliently deformed so as to shift the engaging projection 25 to be released from the engagement with the engaging edged recess 33 provided on the FPC 30 in the same manner as the case of the engaging edged recess 34 provided on the FPC 30.

Consequently, the FPC 30 inserted in the housing 11 can be easily and appropriately moved to get out of the housing 11.

In the case where the FPC 30 is provided thereon a pair of engaging edged holes in place of the engaging edged recesses 33 and 34, the engaging projections 25 of the holding members 18 extending from the upper portion of the conductive shell 14 engage with or disengage from the engaging edged holes, respectively, in the same manner as the case of the engaging edged recesses 33 and 34.

In the electrical connector 10 mentioned above, the indicating portion 27 of the holding member 18 extending from the upper portion of the conductive shell 14 is postured to take up the first position with the top end thereof positioned to face the outside of the conductive shell 14 through the opening 29 formed in the upper portion of the conductive shell 14 when the engaging projections 25 of the holding members 18 engage respectively with the engaging edged recesses 33 and 34 provided on the FPC inserted in the housing 11, and then the indicating portion 27 of the holding member 18 is postured to take up the second position with the top end thereof positioned to project from the inside to the outside of the conductive shell 14 through the opening 29 formed in the upper portion of the conductive shell 14 when the engaging projections 25 of the holding members 18 disengage respectively from the engaging edged recesses 33 and 34 provided on the FPC inserted in the housing 11. However, it should be understood that it is also possible to constitute the electrical connector 10 in such a manner that the indicating portion 27 of the holding member 18 extending from the upper portion of the conductive shell 14 is postured to take up the second position with the top end thereof positioned to project from the inside to the outside of the conductive shell 14 through the opening 29 formed in the upper portion of the conductive shell 14 when the engaging projections 25 of the holding members 18 engage respectively with the engaging edged recesses 33 and 34 provided on the FPC inserted in the housing 11, and then the indicating portion 27 of the holding member 18 is postured to take up the first position with the top end thereof positioned to face the outside of the conductive shell 14 through the opening 29 formed in the upper portion of the conductive shell 14 when the engaging projections 25 of the holding members 18 disengage respectively from the engaging edged recesses 33 and 34 provided on the FPC inserted in the housing 11.

With the electrical connector 10 constituted in accordance with the present invention as described above, when the FPC 30 is inserted into the housing 11 thorough the opening 12 provided thereon, the signal connecting terminals 31 provided on the FPC 30 are automatically connected electrically through the conductive contacts 13 arranged in the housing 11 with the signal terminals provided on the main solid circuit board on which the housing 11 is mounted.

Further, it can be easily confirmed by means of aural check or feeling check from the outside of the conductive shell 14 or by checking visually the indicating portion 27 of the holding member 18 from the outside of the conductive shell 14 that the FPC 30 inserted in the housing 11 has reached the appropriate position in the housing 11 and the engaging projections 25 of the holding members 18 extending from the upper portion of the conductive shell 14 engage respectively with the engaging edged recesses 33 and 34 provided on the FPC inserted in the housing 11. That is, it can be easily, quickly and accurately confirmed from the outside of the electrical connector 10 that the FPC 30 inserted in the housing 11 has reached the appropriate position in the housing 11 to be surely prevented from getting out of the housing 11 unwillingly by the holding members 18 formed in the conductive shell 14.

What is claimed is:

1. An electrical connector comprising;

a housing made of insulator and provided with an opening through which a flat circuit device is inserted into the housing, a plurality of conductive contacts provided to be arranged on the housing and positioned to correspond respectively to connecting terminals provided on the flat circuit device when the flat circuit device is inserted into the housing through the opening provided thereon, a conductive shell mounted on the housing for covering partially the same and provided with a holding member formed in a body therein for holding the flat circuit device inserted in the housing, and a movable lever provided to be rotatable in regard to the housing for taking up a first station and a second station selectively, wherein the holding member formed in the conductive shell comprises an arm portion extending from the conductive shell to the inside thereof, an engaging projection provided at an end of the arm portion for engaging with an engaging edged portion provided on the flat circuit device, a pressure receiving portion extending from the engaging projection for receiving pressure from the movable lever and an indicating portion extending from the pressure receiving portion for indicating a state of the holding member, wherein the engaging projection is operative to engage with the engaging edged portion provided on the flat circuit device inserted in the housing so as to hold the flat circuit device and the indication portion is operative to take up a first position when the movable lever is postured to take up the first station, wherein the pressure receiving portion is operative to be moved by the movable lever to release the engaging projection from engagement with the engaging edged portion provided on the flat circuit device inserted in the housing so as not to hold the flat circuit device and to cause the indication portion to take up a second position different from the first position when the movable lever is rotated from the first station to the second station, and wherein the indication portion taking up at least one of the first and second positions is able to be visually checked from the outside of the conductive shell.

2. An electrical connector according to claim 1, wherein the movable lever has a pair of rotating axis portions supported to be rotatable by the housing and a pressing portion extending from each of the rotating axis portions to be rotatable with an imaginary axis of rotation passing through the rotating axis portions and the pressing portion is operative to cause the engaging projection of the holding member formed in the conductive shell to engage with the engaging edged portion provided on the flat circuit device inserted in the housing when the movable lever is postured to take up the first station and to move the pressure receiving portion of the holding member so as to release the engaging projection of the holding member from the engagement with the engaging edged portion provided on the flat circuit device inserted in the housing when the movable lever is rotated from the first station to the second station.

3. An electrical connector according to claim 2, wherein the rotating axis portions of the movable lever are supported to be rotatable by a pair of end portions of the housing opposite each other in a direction along which the conductive contacts are arranged.

4. An electrical connector according to claim 3, wherein the pressing portion of the movable lever is formed to extend to be winding from the rotating axis portion of the movable lever.

5. An electrical connector according to claim 1, wherein a top end of the indicating portion of the holding member is positioned to face the outside of the conductive shell from the inside of the conductive shell when the indicating portion is postured to take up the first position and positioned to project from the inside to the outside of the conductive shell when the indicating portion is postured to take up the second position.

6. An electrical connector according to claim 1, wherein the holding member is provided at each of portions of the conductive shell which are respectively in the vicinity of a pair of end portions of the conductive shell opposite each other in a direction along which the conductive contacts are arranged.

7. An electrical connector according to claim 1, wherein the holding member is formed with resiliency in the conductive shell, the engaging projection of the holding member is operative to come into press-contact with the flat circuit device inserted in the housing so as to cause the holding member to be resiliently deformed just before engaging with the engaging edged portion provided on the flat circuit device, and the pressure receiving portion of the holding member is operative to hit with resilient force against a portion of the movable lever when the engaging projection of the holding member engages with the engaging edged portion provided on the flat circuit device inserted in the housing.

* * * * *